United States Patent [19]

Lindsey et al.

[11] Patent Number: 4,898,243

[45] Date of Patent: Feb. 6, 1990

[54] LINER AND DRILL PIPE ASSEMBLY

[75] Inventors: Hiram E. Lindsey, Midland; Paul W. Cole, Odesa, both of Tex.

[73] Assignee: Lindsey Completion Systems, Inc., Midland, Tex.

[21] Appl. No.: 147,533

[22] Filed: Jan. 25, 1988

[51] Int. Cl.[4] ..... E21B 23/00; E21B 33/13

[52] U.S. Cl. ..... 166/290; 166/208; 166/382; 166/387

[58] Field of Search ..... 166/290–291, 166/374, 379–383, 386, 387, 154, 208, 212, 217

[56] References Cited

U.S. PATENT DOCUMENTS

| | | | |
|---|---|---|---|
| 2,291,371 | 7/1942 | Buchanan et al. | 166/290 |
| 2,436,525 | 2/1948 | O'Donnell | 166/290 X |
| 3,253,655 | 5/1966 | Brown | 166/290 X |
| 3,910,349 | 10/1975 | Brown et al. | 166/208 X |
| 4,060,131 | 11/1977 | Kenneday et al. | 166/208 X |
| 4,096,913 | 6/1978 | Kenneday et al. | 166/290 |
| 4,479,544 | 10/1984 | Callihan et al. | 166/290 |
| 4,712,614 | 12/1987 | Allwin et al. | 166/208 |

*Primary Examiner*—Bruce M. Kisliuk

*Attorney, Agent, or Firm*—Donald H. Fidler

[57] ABSTRACT

A system for cementing liners in well bores where a liner and drill pipe are made up in telescopic relationship with the lower end of the drill pipe having a polished mandrel or slick pipe slidably and sealingly received in a sealing bore receptacle in the lower end of the liner at a location just above the cementing equipment. When an interconnected setting tool and liner hanger are attached to the drill pipe and liner, a continuous passage is formed by the drill pipe from the setting tool to the location below the sealing bore receptacle. The polished mandrel has an upper normally closed sleeve valve and a lower normally open check valve so that when the liner hanger is located in the well bore, the check valve can be closed for hydraulic operation of the setting tool and opened thereafter for cementing. The sleeve valve is opened at the end of the cementing operation to bypass the interior of the pipe string to the interior of the liner.

7 Claims, 3 Drawing Sheets

LINER AND DRILL PIPE ASSEMBLY

FIELD OF THE INVENTION

This invention relates to methods and apparatus for cementing liners in a well bore and more particularly to methods and apparatus for hanging a liner and for cementing a liner in place during a single trip into a well bore while using an independent section of drill pipe extending through the liner for conveying a cement slurry through the liner.

BACKGROUND OF THE PRESENT INVENTION

In the completion of oil wells the practice is to drill a well bore from the earth's surface, insert a tubular steel casing in the well bore and fill the annulus between the casing and well bore with a cement slurry which hardens to support the casing in the well bore. Thereafter, a deeper section of well bore with a smaller diameter than the surface casing is drilled. The drilling bit is removed and a liner, which is a string of connected lengths of tubular, steel pipe joints, is lowered through the casing and into the open well bore. The liner at its upper end is attached to a setting tool and liner hanger which, in turn, are attached to a string of drill pipe which supports the weight of the liner on the setting tool as the tool and liner assembly are being lowered into the open borehole. The length of the liner is predetermined usually so as to have its lower end proximate to the bottom of the open well bore with an upper end section and an attached liner hanger overlapping the lower end of the section of casing above. The setting tool is operated to set slips on the liner hanger against and in gripping engagement with the casing so that the liner is "hung" or suspended in the open well bore by the slips in the lower end of a casing or pipe. With a hydraulically operated setting tool, the slips are set by dropping a check valve ball or plug into a removable valve seat in the section of open pipe attached to the setting tool in a location below the hydraulic actuating system. Next, by building up pressure in the drill pipe the slips are set by the hydraulically operated mechanism in the setting tool. Thereafter, by increasing the pressure in the drill pipe, the removable valve seat is sheared out of the bore of the open pipe below the setting tool and falls into the liner. The setting tool then is released from the liner hanger. When the setting tool is released from the liner hanger, the exterior of the open pipe below the setting tool remains sealed off with respect to the bore of the liner so that a cement slurry can be pumped down the drill pipe through the open pipe and through the liner. At the lower end of the liner is a cementing shoe and back pressure valves (sometimes called cementing float equipment) and the slurry of cement is displaced by surface pumping equipment to flow through the cementing shoe and into the annulus between the liner and the open well bore. The cement slurry is displaced upwardly until the volume of cement in the annulus is at a desired level which is generally a level overlapping the top of the liner above. During this operation there is mud or control fluid in the well bore and mud or control fluid driving the cement slurry. Thus, when the cement slurry is introduced through the drill pipe it is generally followed by a cementing plug which wipes the internal surface of the drill pipe as it is moved through the drill pipe to minimize contaminating the cement slurry with mud or control fluid. When the cementing plug reaches the setting tool it latches into a liner cement wiper plug (which is usually typically larger in diameter than the I. D. of the drill pipe) and the liner cement wiper plug then follows the cement slurry. The liner cement wiper plug wipes the I. D. of the liner. The liner cement wiper plug stops when it bumps a landing collar or float equipment in the liner.

As noted above, in the setting operation for the liner hanger with a hydraulic setting tool, it is customary to drop a ball which seats in a ball valve seat in the setting tool at a valve seat location below a hydraulic actuating means. Thus, when hydraulic pressure is applied to the drill pipe the hydraulic pressure actuates the setting mechanism for setting the slips on the liner hanger. Once the slips are set and the liner is hung, the hydraulic pressure in the drill pipe can be increased to shear a shear pin in the ball valve member to release the ball valve member and ball and permit them to be removed from the end of the drill pipe, or alternatively, to open a valve in the drill pipe.

In certain completion operations the above described system is not as economical and efficient as might be desired. For example, where the ID of the liner casing is extremely large, it is not only necessary to wipe the entire cross-section of the liner with a liner plug but also the displacement volume is significantly large which causes problems in longer cement placement time. Also, liners can have two or more sections with different diameters so that cementing plugs may wipe in one size diameter but not another.

As a result of the above noted problems and various other reasons, heretofore from time to time, the practice has been to lower a liner hanger to the desired location and hang the liner as above described. After the liner is hung, the setting tool and attached drill pipe are removed from the well bore prior to the cementing operation. Next, drill pipe with a polished mandrel at its lower end is lowered into the liner until the polished mandrel enters and seals with respect to a sealing bore located at the lower end of the liner. Typically, the sealing bore is part of the float collar or the float shoe. With this arrangement then, cement slurry can be pumped directly through a drill pipe and through the cementing equipment at the lower end of the liner neither contacting the internal bore of the liner nor imposing any pressure to the bore of the liner. However, as can be appreciated, this system requires two trips of a drill pipe, i.e., a first trip of drill pipe with a setting tool to hang the liner and a second trip of drill pipe with a polished surface mandrel to utilize the drill pipe in a sealed bore at the lower end of the liner.

THE PRESENT INVENTION

The present invention is embodied in a method and apparatus in which a liner is made up at the earth's surface in an appropriate length for a well bore. At the lower end of the liner is an internal sealing bore located just above the cement floating equipment. The liner when made up to the desired length and disposed in the well, is initially hung in casing slips at the earth's surface while a drill pipe is connected up joint by joint at the earth's surface and lowered into and through the liner. At the lower end of the drill pipe is a section of polished mandrel which is sized for sliding and sealing engagement within the internal sealing bore in the liner. Also disposed in a section of pipe at the lower end of the drill pipe is a lower ball check valve for operating a hydraulic setting tool and an upper cementing plug valve for opening a bypass in the drill pipe upon completion of the cementing injection. The drill pipe is made up in sections until the polished mandrel is stabbed or inserted into the sealing bore at which time a hydraulic setting tool and liner hanger are attached to the drill pipe and to the liner respectively so that the setting tool can support the liner hanger, the liner and the internal string of drill pipe within the liner. At this time the drill pipe is co-axially disposed within the liner. The surface casing slips are then released and a running-in string of drill pipe is made up by connecting drill pipe joints and the entire assembly of telescoped drill pipe and liner is lowered into the well bore to the desired location depth. At the desired location depth a trip ball or plug for the check valve is dropped and pumped through the drill pipe to seat in the lowermost check valve in the drill pipe so that a hydraulic pressure buildup can occur in the drill pipe for actuating the hydraulic setting mechanism in the setting tool. The setting tool then brings the slips of the liner hanger into setting engagement with the inner wall of the next above casing or pipe.

When the setting tool is actuated and the slips on the liner hanger are set, an increase or pressure buildup in the drill pipe causes the lower check valve to open a port and the valve is retained in the drill pipe while the lower end of the drill pipe is opened to the port. As is typical in a cementing operation, the setting tool is then disconnected from the liner hanger by release of a threaded nut coupling so that the supporting drill pipe is not connected to the liner hanger during the cementing operation and the polished mandrel at the lower end of the string of drill pipe remains in sealing relationship to the sealing bore in the liner. Thereafter, cement can be pumped down the drill pipe from the earth's surface through a drill pipe of substantially uniform internal diameter and the calculated volume of cement slurry can be followed by a cement wiper plug in the well-known manner. When the cement wiper plug engages the upper bypass valve in the liner, the bypass valve is opened so that the interior of the liner and the interior of the drill pipe are in fluid communication after the cementing operation is complete thereby relieving the drill pipe from retrieving any fluid when the drill pipe is removed.

DESCRIPTION OF THE PRESENT INVENTION

Figure 1:
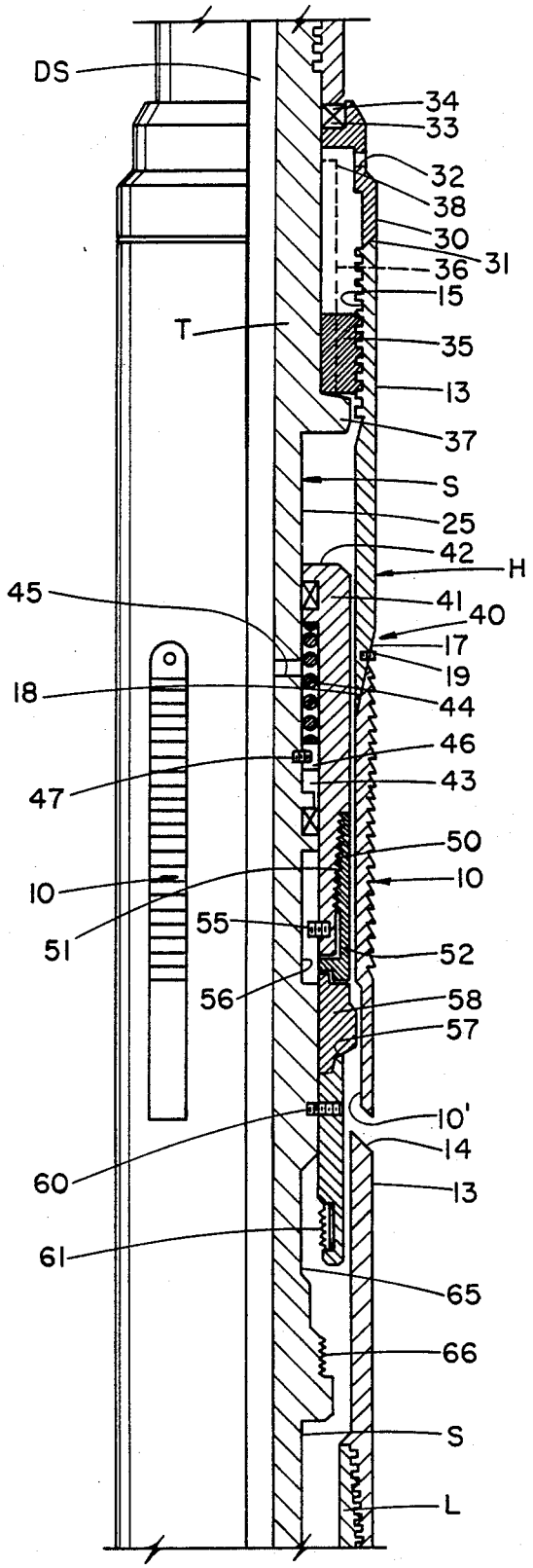
FIG. 1 is a view in partial longitudinal cross-section of a liner hanger H with a depending liner L where the liner hanger H is releasably coupled to a setting tool T attached at an upper end to a drill string DS and releasably attached at its lower end to a drill string S.

Referring now to FIG. 1, a liner L is coupled to a liner hanger H which has circumferentially disposed slip elements or slips 10 for gripping engagement with a well casing. The slip elements 10 are normally disposed within the outer wall of the liner hanger so that the slips do not project outwardly of the circumferential outer surface of the liner hanger H. The slip elements or slips 10 are movable radially outward to bring outer serrated surfaces of the slips into gripping engagement with the inner wall of a well casing. The liner hanger and liner are releasably connected to a setting tool T which, in turn, is connected to a work or drill string DS. Thus, the work string can be used to lower and manipulate the liner and liner hanger prior to setting the liner.

The liner Hanger H includes a tubular outer member 13 which has elongated, circumferentially spaced slip slots 14 (See FIG. 1) and is attachable at its lower end to a liner. At the upper end of the outer member 13 is an internal left-hand thread 15. The side edges of the slips 10 and the side edges of the slots 14 have sliding, inclined tongue and groove connections (not shown) which provide for sliding movement between the contracted unset position shown and an extended position in engagement with the wall of a well casing. At the upper end of each slot 14 is an inclined surface 17. A complimentarily inclined surface 18 on a slip is arranged to move parallel to the surface 17. Surfaces 17 and 18 may be in sliding contact or may be separated from one another as the tongue and groove slots provide the appropriate expander sliding and load supporting surfaces. The inclined surface 17 and keyed tongue and groove slots constitute expander means for a slip member. A shear pin 19 is disposed on the inclined surface 17 to releasably retain a slip in a retracted position.

The setting tool T includes a tubular inner member 25 which is attachable at its upper end to a drill string DS and attachable at its lower end to a drill string "S". The inner member 25 carries a bearing housing 30, a release nut 35 and a unitary hydraulic-mechanical actuator means 40. The bearing housing 30 has a lower end 31 adapted to engage the upper end of the outer member 13. The housing 30 has a number of bypass ports 32. The upper end of the housing 30 contains a rotational bearing 33. The rotational bearing 33 on the housing 30 is engagable with a downwardly facing shoulder 34. The housing 30 includes a flange 37 below the bearing 33. The flange 37 and bearing 33 are contained between the downwardly facing shoulder 34 and an upwardly facing shoulder 38 on the inner member 25. Below the shoulder 38, the inner member 25 has a section of non-circular cross-section forming splines 36 which slidably and non-rotatively receive a non-circular bore in the release nut 35. The release nut 35 has external left-hand threads which threadably and releasably engage with the internal threads 15 in the outer member 13. The release nut 35 and threads 15 define interconnecting means for releasably interconnecting the inner and outer members. Below the nut 35, the inner member 25 has the flange 37 which supports the nut 35 and hence the liner on the inner member 25. Below the flange 37 is the unitary hydraulic-mechanical actuator means 40 which includes an outer actuator sleeve member 41 slidably mounted on the inner member 25. The sleeve member 41 has inwardly facing flange 42 with a sealing means bearing against the inner member 25 and the inner member 25 has an outwardly facing flange 43 with a sealing means bearing against the inner wall of the sleeve member 41. Between the flanges 42 and 43, an annular chamber 44 is defined and a port 45 provides fluid access from the bore of the inner member 25 to the annular chamber 44. Near the lower end of annular chamber 44 an annular stop ring 46 is connected by a shear pin 47 to the inner member 25. Between the stop ring 46 and the upper flange 42 is a spring 48 under compression.

The structure defining the annular chamber 44 defines a hydraulic-mechanical actuator means which is movable between contracted and expanded positions.

At the lower end of the sleeve member 41 is an externally threaded section 50 which engages with a threaded section 51 on a tubular dog collar 52. The lower end of the sleeve member 41 also has a pin member 55 which is slidably received in a longitudinal guide or key slot 56 in the inner member 25. The sections 50 and 51, when released from a threaded interconnection, permit the sleeve member 41 to be moved upwardly by the spring 48. The releasable connection thread 15 in the outer member 13 is made with a greater number of threads than the number of threads on threaded section 51. In practice, twenty turns or rotations are required to release the nut 35 while eighteen turns or rotations of the drill string are required to release the thread 51.

The dog collar 52 has rectangular slots 57 which slidably receive rectangular dog members 58. The dog members 58 have ears, on a base portion projecting beyond the opening of a slot 57 so that a dog member 58 cannot fall out of a slot. The ends of the dog members 58 which project outwardly from the dog collar 52 have inwardly tapered surfaces and are disposed in a recess 10' in the lower end of a slip 10.

In the lower end of the dog collar 52 a shear pin 60 releasably connects the dog collar 52 to the inner member 25. At the lower end of the dog collar 52 is a resilient annular ratchet ring 61 with internal ratchet teeth. The ring 61 is contained in an internal recess in the end of the dog collar 52. The dog collar 52 defines slip actuator means for moving the slip means in response to the hydraulic-mechanical actuator means. The shear pin 60 is a release means for holding the actuator means in a contracted position while the spring is compressed.

In the position shown the inner member 25 has an unlocking recess 65 and an external annular ratchet 66 at its lower end. The recess 65 and ratchet 66 are arranged so that when the ratchet 66 engages the ratchet ring 61, the recess 65 is disposed under the dog members 58.

In the operation of the tool, the hanger slips 10 can be set either mechanically or hydraulically. For hydraulic setting, the liner, liner hanger, setting tool and drill string are lowered to the level in the borehole or casing where the hanger is to be set. A sealing ball (not shown) is dropped through the drill string to a ball check valve 86 (FIG. 2) which is in the lower end of the drill pipe S. The drill pipe S is sealed off relative to the liner L by a sealing bore receptacle 70 (See FIG. 2). By pressuring up on the fluid in the drill string, pressure in the annular chamber 44 shears the pin 60 first and then the hydraulic force on the sleeve member 41 (as well as the spring force) moves the dogs 58 upwardly engaging the lower end of the slips 10. The shear pin 19 for a slip 10 is sheared and the slips are moved outwardly along the inclined surfaces 17 to engage the well casing for supporting the weight of the liner. The drill string is lowered and right hand rotation of the drill string unthreads the nut 35 from the outer member 13. At the same time the sleeve member 41 unscrews from the dog collar 52 (at the threaded connection 50 and 51) so that the inner member can be disengaged from the outer member 13. Upon moving the drill string upwardly, the ratchet 66 on the inner member 25 engages the ratchet ring 61 and the recess 65 permits the dogs 58 to be released and moved inwardly from the slips so that the dogs are locked in position relative to the recess 65. The entire setting tool assembly is retrieved leaving only the slips and the liner hanger in the casing.

To set the hanger mechanically, the liner is brought into engagement with the bottom of a well bore so that the inner member 25 can be rotated relative to the outer member 13. By rotating the drill string, the shear pin 60 is sheared and the spring 48 moves the sleeve element 41 and dog member 52 upwardly. The spring force of the spring 48 causes the dogs 58 to be moved to a position in engagement with the slip shoulder **10*a*. Upon lifting the drill string in an upward direction, the flange 37 below the nut 35 contacts the flange 37. Continued upward pull on the drill string shears the shear pin 19 and releases the slips 10. The drill string then is used to move the liner to the desired location while the slips are dragged along the well bore surface and are being pushed outwardly by the spring force only. At the desired location for hanging the liner, the drill string is lowered thus setting the slips 10 and hanging the liner in a well casing. Next, the drill string is lowered and the nut cover 30 is in engagement with the outer member 13 so that rotation of the drill string releases the nut 35 and the setting tool from the outer member 13 of the liner hanger. At this time, the inner member 25 can be raised so that the ratchet 66 engages the ratchet ring 61 and the release groove or recess 65 releases the dogs 58** from the slip elements.

The foregoing tool as described in FIG. 1 is more completely described in U.S. Pat. No. 4,712,614, issued December 15, 1987 to Roger Allwin and Mark Budke.

Figure 2:
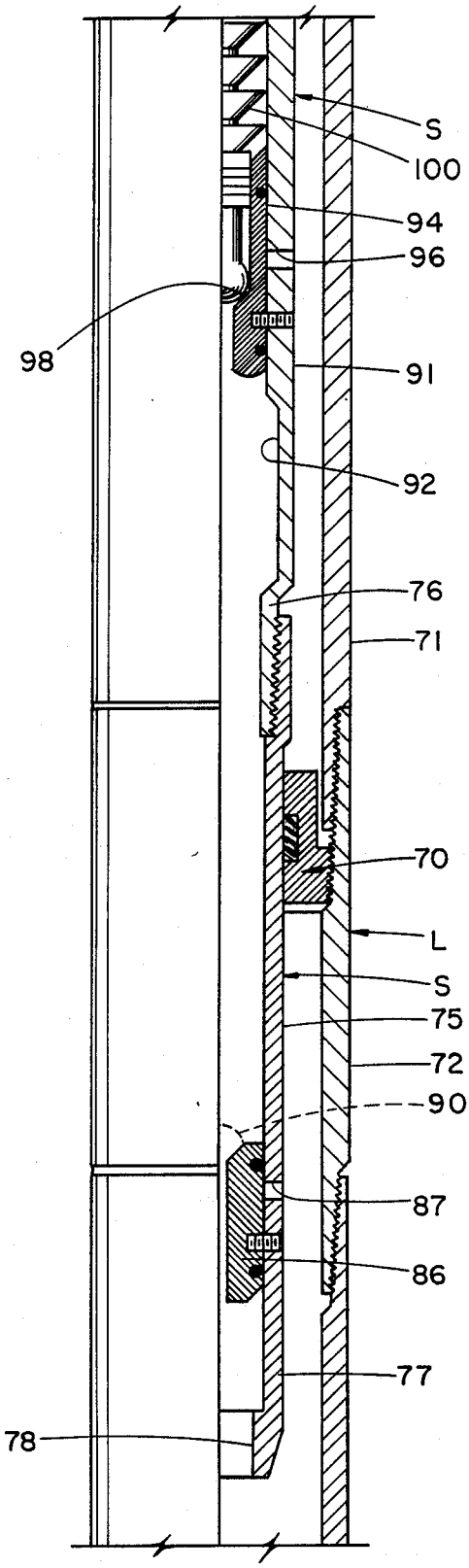
FIG. 2 is a view in partial longitudinal cross-section of the liner L and drill string S at a location at the lower end of the liner and the drill string S just above the cementing equipment 112.

Referring now to FIG. 2, a lower end of the liner L is illustrated. Between threaded coupled sections 71,72 of the liner L is the tubular sealing bore receptacle 70 which has a pressure pack-off device. Slidably and sealing disposed in a sealing bore is a polished mandrel 75 which is threadedly coupled to the lower end of a drill pipe section 76. At the lower end of the polished mandrel 75 is a tubular end member 77 having a lower internal and inwardly extending flange 78. A tubular check valve 86 is sealing received in the end member 77. The check valve 86 has seals disposed above and below a communication port 87 in the end member 77. The valve 86 is releasably attached to the end member 77 by a shear pin. The central portion of the valve 86 has bore therethrough and an upper flared opening which is adapted to receive a sealing ball 90. Thus, when a sealing ball can be positioned in the bore of the valve 86, the check valve contains pressure in the drill pipe above the check valve until the shear value of the shear pin is reached. When the shear pin is sheared the valve member 86 is displaced downwardly to open the port 87 so that the interior of the drill pipe is in fluid communication with the interior of the liner below the sealing bore receptacle 70. Just below the lower end of the end member 77 is conventional cementing equipment which is attached to the end of the liner L.

In the section of drill pipe S above the polished mandrel 75 there is a drill pipe section 91 with an enlarged annular recess portion 92. Above the recessed portion 92 is a tubular plug valve 94. The tubular plug valve 94 has exterior seal members disposed above and below a circulating port 96 and is connected by shear pin to the drill pipe section 91. The plug valve 94 has a portion of reduced diameter to form a landing shoulder 98. Thus a conventional cementing plug 100 with elastomer wiping cups and annular sealing means can be moved down the drill pipe S behind a cement slurry. After the cementing plug 100 sealingly engages the plug valve 94, pressure in the drill pipe is increased to shear the shear pin which displaces the valve 94 to open the circulating ports 96 and place the interior of the drill pipe S in fluid communication with the interior of the liner above the sealing bore receptacle 70. The recess 92 below the plug valve 94 is sized to permit fluid to bypass the wiper cups on the cementing plug 100 and prevent a pressure lock from a location below the plug.

Figure 3:
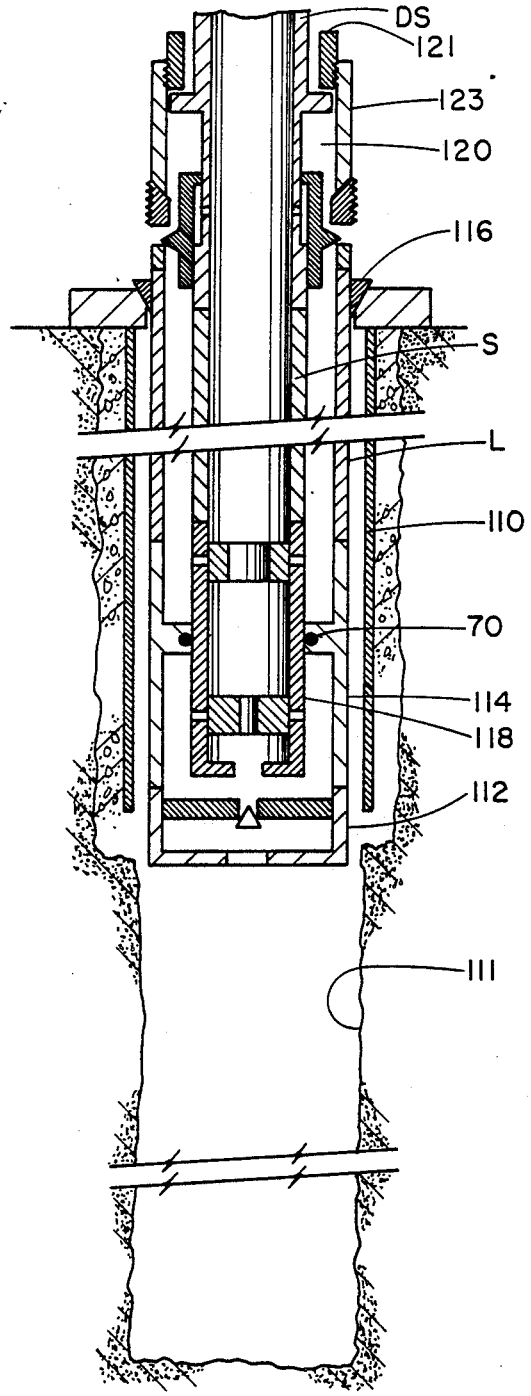
FIG. 3 is an illustration of a liner hanger and setting tool assembled and held in casing grips at the earth's surface.
Figure 4:
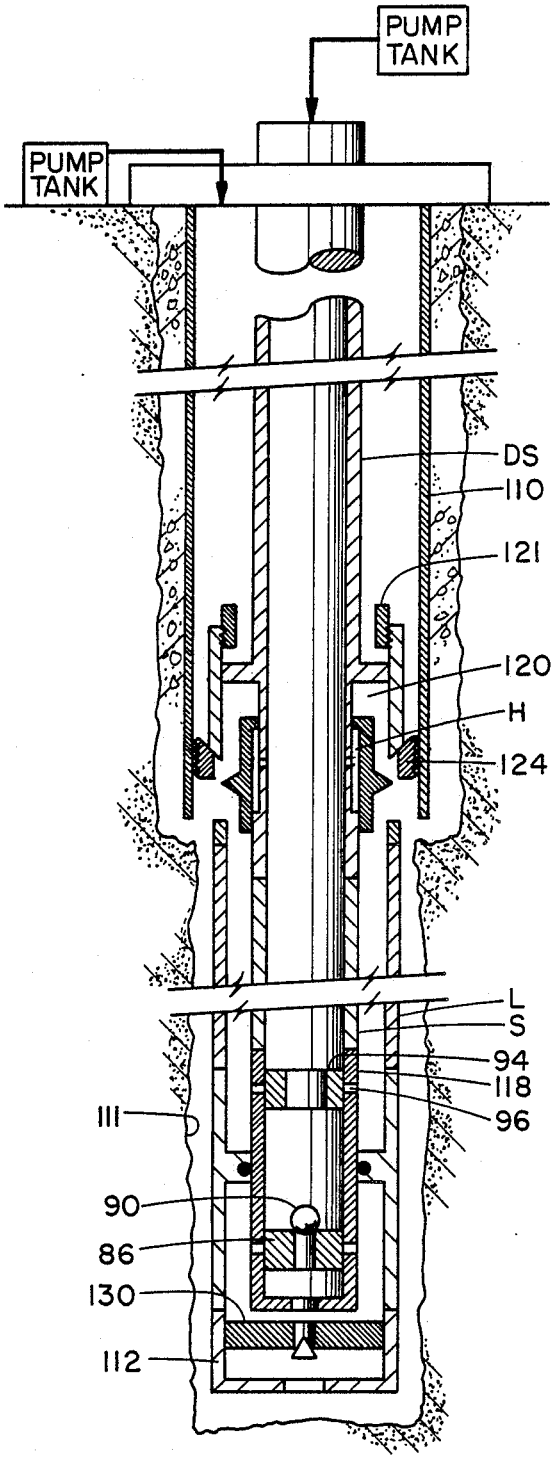
FIG. 4 is a schematic illustration of a liner hanger and drill pipe located in position in a well bore with a hydraulic sealing ball positioned for actuation of the hydraulic setting tool.
Figure 5:
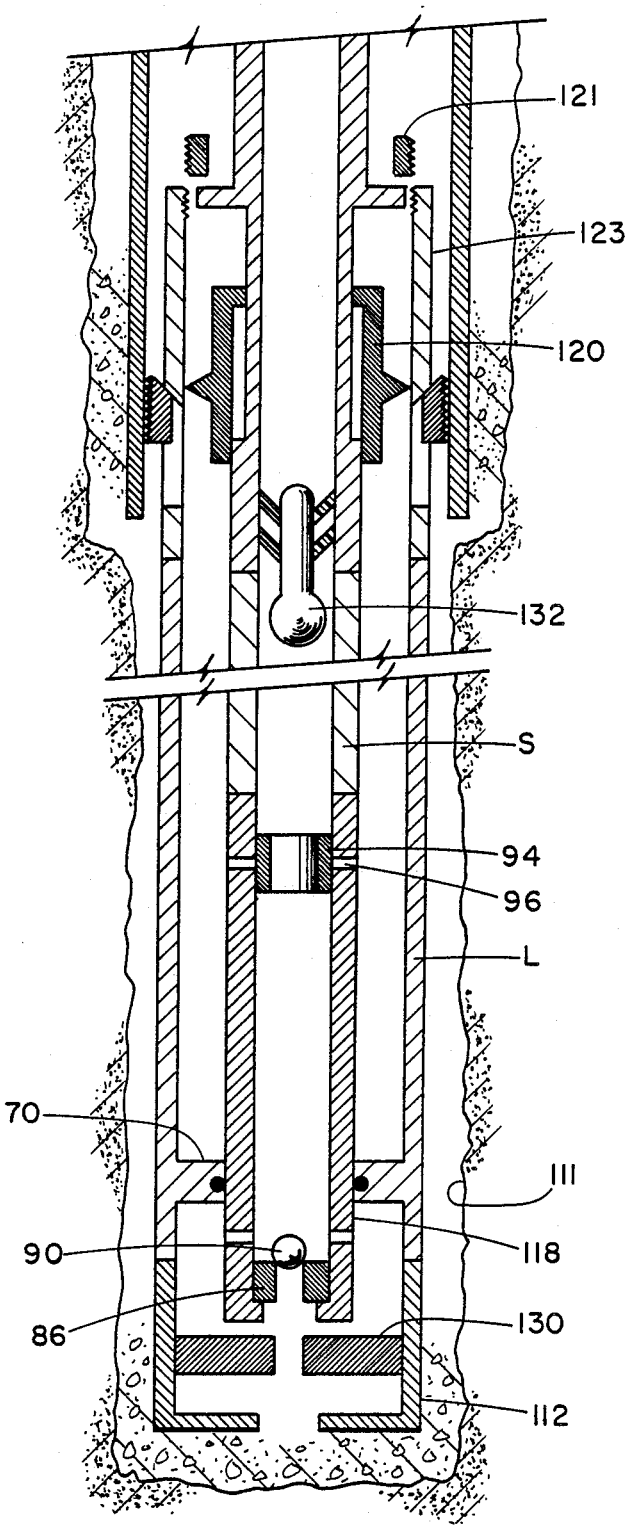
FIG. 5 is a schematic illustration in cross-section of the lower section of equipment in a well bore where the hydraulic valve has been released and the cement wiper plug is traveling behind a column of cement.

The method of the present invention is illustrated schematically in FIGS. 3–5. A casing 110 is cemented in a well bore extending from the earth's surface and there is a section of open well bore 111 below the casing 100. The cementing equipment 112, which includes a conventional cementing shoe and float collars (one way back pressure valves), is connected to a section 114 of liner containing the sealing bore receptacle 70. The remaining sections of liner pipe joints are connected up until the length of the liner L is to the predetermined length necessary for the open borehole. When the predetermined length of liner L has been coupled up, the liner L is hung or supported on the drilling rig by casing slips 116. Next a polished mandrel and a valve assembly 118 (illustrated in detail in FIG. 2) are connected to a drill pipe S and the drill pipe sections for the drill pipe S are connected up until the appropriate length of drill pipe S is within the liner hanger L where the polished mandrel will sealingly engage the sealing bore receptacle 70. Next, the setting tool assembly 120 and liner hanger assembly 123 (see (FIG. 1) are attached to the drill pipe S and the liner L. A release assembly 123 nut 121 interconnects the setting tool assembly 120 to liner hanger assembly 123. With the telescoped liner L and drill pipe S thus connected, the weight of the drill pipes, the liner L and the liner hanger assembly 123 are carried by the setting tool assembly 120 which is lowered by continuation of the drill pipe D. S. until the liner L is in position for cementing as shown in FIG. 4.

When the liner L is in position for hanging, the cementing ball 90 is pumped down by hydraulic fluid to seat against the check valve 86 at the lower end of the drill pipe S where the sealing ball 90 is smaller in diameter than the bore through the plug valve 94. When the check valve 86 is closed off, hydraulic pressure can be applied to the drill pipe D. S. and S to actuate the hydraulic setting mechanism H in the setting tool assembly 120 to set the slips 124 of the liner hanger assembly 123 in the casing 110. The setting of the slips 124 thus effectively hangs the liner L from the next above casing 110. By increasing the pressure the valve 86 can be displaced to the end of the assembly 118 so that cement slurry can be passed through the open port in the drill pipe. The setting tool assembly 120 next can be released by right hand rotation to separate the setting tool nut 121 from the liner hanger assembly 123. With the setting tool assembly 120 released from the liner hanger assembly 123, the polished mandrel in the assembly 118 remains in sealing contact relationship to the sealing bore receptacle 70 at the lower end of the liner L and a cement slurry can be pumped through the drill pipe and through the cementing float equipment 130 below the sealing bore to inject the cement slurry to the annulus between the liner L and the open bore 111.

As shown in FIG. 5, cement slurry is moved upwardly into the annulus and displaces fluid upwardly in the annulus which is removed at the earth's surface. When the cement wiper plug 132 following the cement slurry engages the plug valve 94, the plug valve 94 is opened so that the bore of the drill pipe S is placed in fluid communication with the bore of the liner L above the sealing bore receptacle 70 by the port 96. Thus there is a pressure equalization between the inner and outer space of the drill pipe S and the drill pipe S then can be removed together with the setting tool assembly 120. The liner L having been cemented in place, all of the operations being conducted on a single trip of the drill pipe in the well bore.

In summary of the method of the present invention, a liner is made up at the earth's surface in an appropriate length for a well bore. At the lower end of the liner is an internal sealing bore receptacle located just above the cement floating equipment. The liner when made up and disposed in the well is hung on surface casing slips at the earth's surface. A drill pipe is next connected up joint by joint at the earth's surface and lowered into the liner. At the lower end of the drill pipe is a section of polished mandrel which is sized for sliding and sealing reception within the sealing bore receptacle in the liner. Also disposed in the section of drill pipe at its lower end is a ball check valve for use in operating a hydraulic setting tool and an upper cementing plug valve for opening a bypass in the drill pipe upon completion of the cementing operation. The drill pipe is made up in sections until the polished mandrel is stabbed or inserted into the sealing bore receptacle at which time a conventional hydraulic setting tool and a liner hanger are attached to the liner and to the drill pipe. The casing slips are then released and a string of drill pipe is made up in sections and used to lower the assembly of drill pipe and liner attached to the setting tool and the liner hanger into the well bore to the desired location depth. At the desired location depth, a trip ball for the ball check valve is dropped and pumped through the drill pipe to seat in the lowermost check valve in the drill pipe so that a hydraulic pressure buildup can occur in the drill pipe for actuating the hydraulic setting mechanism in the setting tool. The setting tool then brings the slips of the liner hanger into setting engagement with the inner wall of the next above casing or pipe.

When the setting tool is actuated and the slips on the liner hanger are set, an increase or pressure buildup in the drill pipe causes the lower check valve to open thereby opening the lower end of the drill pipe. As is typical in a cementing operation the setting tool is then disconnected from the liner hanger by release of the threaded nut coupling so that the drill pipe is not connected to the liner hanger during the cementing operation but the polished mandrel at the lower end of the string of drill pipe remains in sealing relationship to the sealing bore receptacle in the liner. Thereafter, cement can be pumped from the earth's surface through the drill pipe which has substantially uniform internal diameter and the calculated volume of cement slurry can be followed by a cementing plug in the well-known manner. When the cementing plug engages the upper bypass valve in the drill pipe, the bypass valve is opened so that the interior of the liner and the interior of the drill pipe are in fluid communication thereby relieving the drill pipe from containing fluid.

In the foregoing description, the liner utilizes a liner hanger by which a liner is hung off of the bottom of the well bore. It is also within the scope of this invention to utilize an adapter on the upper end of the liner to releasably attach the liner to a setting tool and to set the liner on the bottom of the well bore rather than hang the liner in the casing above.

It will be apparent to those skilled in the art that various changes may be made in the invention without departing from the spirit and scope thereof and therefore the invention is not linited by that which is enclosed in the drawings and specifications, but only as indicated in the appended claims.

We claim:

1. A method of cementing a liner in a well bore comprising the steps of:

making up sections of pipe to form a liner disposed in a well bore to a desired length of liner, supporting the desired length of liner at the earth's surface while making up sections of drill pipe to form a desired string of drill pipe co-axially disposed within the desired length of liner where the desired string of drill pipe has a polished mandrel at its lower end and the desired length of liner has a sealing bore receptacle at its lower end which is disposed just above cementing equipment attached to the lower end of the desired length of liner, when the polished mandrel is in position for sealing reception in the sealing bore receptacle, attaching a setting tool assembly to the desired string of drill pipe and attaching a liner hanger assembly with liner hanger slips to the desired length of liner, where the setting tool assembly and the liner hanger assembly are releasably interconnected while the polished mandrel is in the sealing bore receptacle, and where there is a hydraulically operated setting mechanism in the setting tool assembly for operating the liner hanger slips and a releasable pressure valve at the lower end of the desired string of drill pipe for use in developing hydraulic pressure for operating said hydraulically operated setting mechanism, releasing the liner at the earth's surface and making up a supporting string of drill pipe attached to the setting tool assembly for lowering the co-axially disposed (telescoped) desired length of liner and desired string of drill pipe through the well bore to a desired liner location in the well bore, hanging the liner in the well bore with liner hanger slips at a desired liner location in the well bore by applying hydraulic pressure to operate the setting tool and the step of applying an increased hydraulic pressure for releasing the pressure valve and opening the end of the drill pipe, pumping a volume of cement slurry through the supporting string of drill pipe, the setting tool assembly and the desired string of drill pipe to a location below the sealing bore receptacle for injecting cement slurry into the annulus between the well bore and the desired length of liner, and upon the trailing end of the volume of cement slurry reaching the lower end of the desired string of drill pipe, opening the interior of the desired string of drill pipe to the interior of the liner at a location above the sealing bore receptacle.

2. A method of cementing a liner in a well bore comprising the steps of:

making up sections of pipe to form a liner disposed in a well bore to a desired length of liner, supporting the desired length of liner at the earth's surface while making up sections of drill pipe to form a desired string of drill pipe co-axially disposed within the desired length of liner where the desired string of drill pipe has a polished mandrel at its lower end and the desired length of liner has a sealing bore receptacle at its lower end disposed just above cementing equipment attached to the end of the desired length of liner and where the polished mandrel has a upper normally closed sleeve or port valve and a lower normally open check valve, when the polished mandrel is in position for sealing reception in the sealing bore receptacle, attaching a hydraulically set setting tool assembly to the desired string of drill pipe and attaching a liner hanger with liner hanger slips to the desired length of liner, where the setting tool assembly and liner hanger are releasably interconnected by a release nut while the polished mandrel is sealingly engaged in the sealing bore receptacle, releasing the liner at the earth's surface and making up a supporting string of drill pipe attached to the setting tool assembly for lowering the coextensively disposed desired length of liner and desired string of drill pipe through the well bore to a desired liner location in the well bore, dropping a sealing member into the drill pipe for closing said lower check valve, hanging the liner in the well bore with liner hanger slips at a desired liner location in the well bore by applying a first hydraulic pressure to the drill pipe, and thereafter, opening the closed lower check valve by applying a second higher hydraulic pressure, pumping a volume of cement slurry through the supporting string of drill pipe, the setting tool assembly and the desired string of drill pipe to a location below the sealing bore receptacle for injecting cement slurry into the annulus between the well bore and the desired length of liner, and following the trailing end of the volume of cement slurry with a valve shifter for opening the sleeve valve upon reaching the lower end of the desired string of drill pipe to place the interior of the desired string of drill pipe in communication with the interior of the liner at a location above the sealing bore receptacle.

3. The method as set forth in claim 2 and further including the step of releasing the setting tool assembly from the liner hanger while maintaining a continuous passageway to a location below the sealing bore receptacle prior to pumping the cement slurry, and removing the supporting string of drill pipe, the setting tool assembly and the desired string of drill pipe from the well bore after pumping the cement slurry.

4. Apparatus for cementing a liner in a well bore including a setting tool assembly connectable between a supporting string of drill pipe and a desired string of drill pipe, a liner hanger assembly connectable to a liner, said liner hanger assembly having slip means, said setting tool assembly having means for setting said slip means, said setting tool assembly having releasable means interconnectable with said liner hanger assembly, said setting tool assembly having a hydraulically actuated setting mechanism, and polished mandrel means including a releasable check valve which can be closed with a plug element and released by a hydraulic pressure greater than the hydraulic pressure required to actuate said setting mechanism.

a sealing bore receptacle connectable to a lower end of (a) said liner for slidably and sealingly receiving (a) said polished mandrel means, said polished mandrel means being connectable to a lower end of (a) said desired string of drill pipe whereby (a) said setting tool assembly and (a) said liner hanger assembly can be releasably interconnected and can be attached respectively to (a) said desired string of drill pipe and to (a) said liner in a lengthwise-extending relationship and where the polished mandrel means is sealingly received in the sealing bore receptacle so that there is a continuous flow passage in the desired string of drill pipe from the setting tool assembly to a location below the sealing bore receptacle exclusive of the liner.

5. The apparatus as set forth in claim 4 wherein said polished mandrel means includes a sleeve valve located above said sealing bore receptacle which is operable in response to a cementing plug for placing the interior of a desired string of drill pipe in communication with the interior of a liner.

6. A method of cementing a liner in a well bore comprising the steps of:

making up sections of pipe to form a liner disposed in a well bore to a desired length of liner, supporting the desired length of liner at the earth's surface while making up sections of drill pipe to form a desired string of drill pipe co-axially disposed within the desired length of liner where the desired string of drill pipe has a polished mandrel at its lower end and the desired length of liner has a sealing bore receptacle at its lower end disposed just above cementing equipment attached to the lower end of the desired length of liner, when the polished mandrel is in position for sealing reception in the sealing bore receptacle, attaching a setting tool assembly to the desired string of drill pipe and attaching the setting tool assembly to an adapter on the desired length of liner, where the setting tool assembly and adapter are releasably interconnected while the polished mandrel is in the sealing bore receptacle, releasing the liner at the earth's surface and making up a supporting string of drill pipe attached to the setting tool assembly for lowering the co-axially disposed desired length of liner and desired string of drill pipe through the well bore to a desired liner location in the well bore, placing the liner in the well bore on the bottom of the well bore, pumping a volume of cement slurry through the supporting string of pipe, the setting tool assembly and the desired string of drill pipe to a location below the sealing bore receptacle for injecting cement slurry into the annulus between the well bore and the desired length of liner, and upon the trailing end of the volume of cement slurry reaching the lower end of the desired string of drill pipe, opening the interior of the desired string of drill pipe to the interior of the liner at a location above the sealing bore receptacle.

7. The method as set forth in claim 6 and further including the step of releasing the setting tool assembly from the adapter while maintaining a continuous passageway to a location below the sealing bore receptacle prior to pumping the cement slurry, and removing the supporting string of drill pipe, the setting tool assembly and the desired string of drill pipe from the well bore after pumping the cement slurry.

* * * * *